United States Patent [19]

Grooms, Jr.

[11] Patent Number: 4,700,721

[45] Date of Patent: Oct. 20, 1987

[54] CIGARETTE INCENSE ASHTRAY HOLDER

[76] Inventor: Dennis B. Grooms, Jr., 1075 Castleton Ave., 2C, Staten Island, N.Y. 10310

[21] Appl. No.: 899,965

[22] Filed: Oct. 14, 1986

[51] Int. Cl.[4] ..... A24F 19/00

[52] U.S. Cl. ..... 131/238; 131/231; 131/240.1; 131/241

[58] Field of Search ..... 131/238, 231, 235.1, 131/240.1, 241

[56] References Cited

U.S. PATENT DOCUMENTS 3,160,162 12/1964 Nunez ..... 131/238

*Primary Examiner*—V. Millin

[57] ABSTRACT

An ashtray comprising an incense holder. The incense holder is an aluminum tube inserted into a hole in the base of the ashtray. The tube includes clay inserted into the tube to aid in securing an incense stick.

1 Claim, 3 Drawing Figures

CIGARETTE INCENSE ASHTRAY HOLDER

BACKGROUND OF THE INVENTION

The invention pertains to a cigarette ashtray with an incense holder attached thereto.

SUMMARY OF THE INVENTION

The cigarette incense ashtray holder comes in an assortment of colors. The ashtray can be constructed out of melamine and is break resistant.

DETAILED DESCRIPTION OF THE INVENTION

Figure 1:
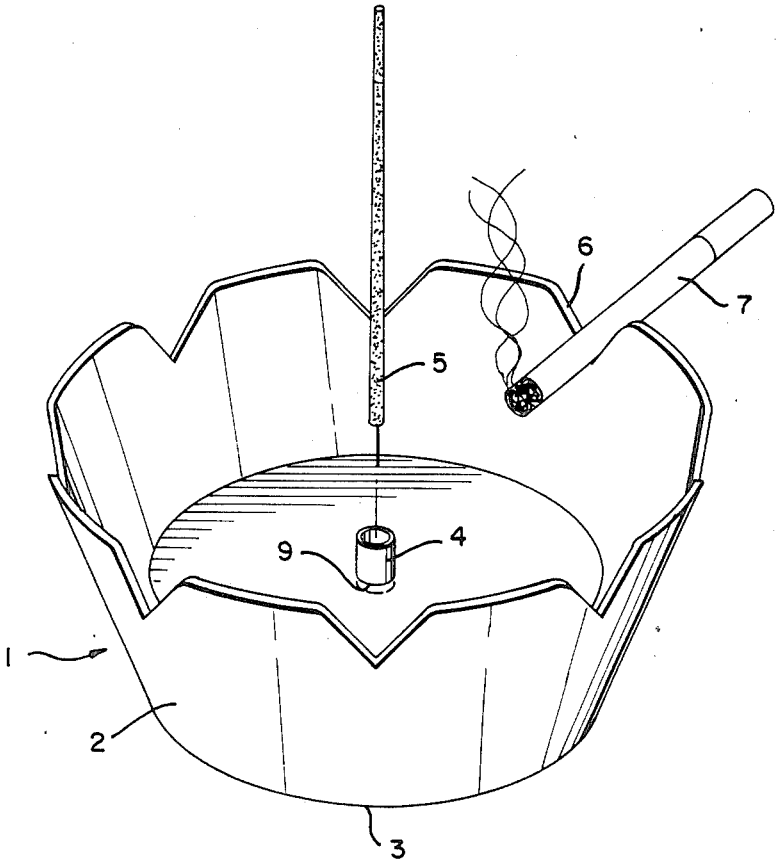
FIG. 1 illustrates an ashtray with an incense holder according to the invention.
Figure 3:
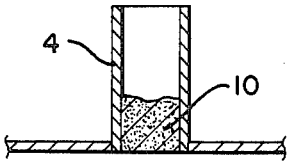
FIG. 3 illustrates the tube or incense holder employed in the ashtray of FIG. 1.

FIG. 1 illustrates an ashtray (1). An ash receiving means defined by that area bounded by the interior of wall (2) and base (3). An aluminum tube (4) snugly fits into a hole (9) drilled through base (3). The aluminum tube (4) has a first end inserted into the hole (9) and a second end above the hole after the tube is inserted into the hole. The tube at its first end is plugged by a piece of clay (10). The clay is illustrated in FIG. 3. An incense stick (5) is inserted into the tube and is secured in the tube by having stick 5 also inserted into the clay. Notches (6) are provided to hold cigarettes (7).

Figure 2:
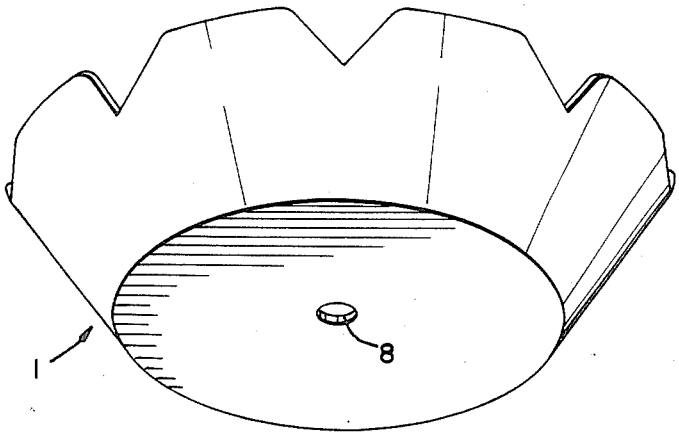
FIG. 2 illustrates a bottom view of the ashtray in FIG. 1.

FIG. 2 illustrates drilled hole (8) through the base of the ashtray without the tube inserted therein.

What is claimed is:

1. An ashtray comprising:

(a) an ash receiving means having a base;

(b) a hole through said base;

(c) an aluminum tube fitted snugly into said hole;

(d) said aluminum tube having a first end inserted into said hole and a second end above said hole when first end is inserted;

(e) said tube at said first end being plugged by a piece of clay;

(f) an incense stick inserted into said tube and into said clay so as to secure said incense stick in said tube.

* * * * *